US006934505B2

(12) United States Patent
Shin

(10) Patent No.: US 6,934,505 B2
(45) Date of Patent: Aug. 23, 2005

(54) IMAGE FORMING APPARATUS

(75) Inventor: Sang-yob Shin, Suwon (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 84 days.

(21) Appl. No.: 10/619,606

(22) Filed: Jul. 16, 2003

(65) Prior Publication Data

US 2004/0028438 A1 Feb. 12, 2004

(30) Foreign Application Priority Data

Aug. 12, 2002 (KR) ..... 2002-47608

(51) Int. Cl.[7] ..... G03G 15/00

(52) U.S. Cl. ..... 399/395; 399/372; 399/388; 400/630; 400/632; 271/245

(58) Field of Search ..... 399/395, 388, 399/394, 372; 400/630, 632; 271/245

(56) References Cited

U.S. PATENT DOCUMENTS 5,130,757 A * 7/1992 Ito ..... 399/14
5,678,488 A * 10/1997 Yamaguchi et al. ..... 101/483
6,493,534 B2 * 12/2002 Sawanaka et al. ..... 399/316
6,618,576 B2 * 9/2003 Kanari et al. ..... 399/388
6,687,479 B2 * 2/2004 Leute et al. ..... 399/316
6,739,778 B2 * 5/2004 Fuchi et al. ..... 400/693

* cited by examiner

*Primary Examiner*—Daniel J. Colilla
*Assistant Examiner*—Dave A. Ghatt
(74) *Attorney, Agent, or Firm*—Staas & Halsey LLP

(57) ABSTRACT

A paper transferring device for an image forming apparatus includes a plurality of guide members forming a paper transferring path connecting a paper feeding device and a photosensitive drum, a feeding roller disposed on a side of the paper transferring path adjacent to the photosensitive drum, the feeding roller transferring a paper incoming along the paper transferring path to the photosensitive drum, at least one transferring roller disposed on the paper transferring path between the feeding roller and the paper feeding device, the transferring roller transferring the paper picked-up from the paper feeding device to the feeding roller, and a paper leading edge aligning unit for aligning a leading edge of the paper so that the leading edge of the paper is parallel to a rotation axis of the feeding roller prior to entering the feeding roller to prevent the paper from being skewed.

24 Claims, 5 Drawing Sheets

IMAGE FORMING APPARATUS

This application claims the benefit of Korean Patent Application No. 2002-47608, filed Aug. 12, 2002, in the Korean Intellectual Property Office, the disclosure of which is incorporated herein by reference.

BACKGROUND OF THE INVENTION

1. Field of the Invention

The present invention relates to an image forming apparatus, and more particularly, to a paper transferring device for an image forming apparatus supplying a driving force to transfer paper and simultaneously guiding the transfer of the paper.

2. Description of the Prior Art

As shown in FIGS. 1 and 2, a general image forming apparatus 100 such as a laser printer and a photocopier, for printing a predetermined image on paper supplied from the outside/inside, includes a paper feeding device 110, a developing device 130, and a paper transferring device 140.

The paper transferring device 140 is to supply a driving force to transfer paper picked-up from the paper feeding device 110 to a photosensitive drum 135 of the developing device 130 and simultaneously guide the transferring of the paper along a predetermined path. The paper transferring device 140 includes a plurality of guide members 143 and 145 forming a paper transferring path 141 and paper transferring means disposed on the paper transferring path 141. The paper transferring means generally uses a plurality of rollers rotatably disposed on the paper transferring path 141. By way of an example, FIG. 1 shows the image forming apparatus 100 having the paper transferring means that includes a feeding roller 147 disposed at a side of the paper transferring path 141 adjacent to the photosensitive drum 135 to transfer the paper to the photosensitive drum 135 and at least one transferring roller 148 for transferring the paper picked-up from the paper feeding device 110 to the feeding roller 147.

However, a skew occasionally occurs in the conventional paper transferring device 140 as constructed above. That is, when the paper P passes through the paper transferring path 141 formed in a curved shape, the paper P advances into the feeding roller 147 with its leading edge being in an oblique relationship with respect to a rotation axis 147A of the feeding roller 147, instead of being parallel. Thus, the paper P is skewed as one side of the leading edge of the paper P enters the feeding roller 147 ahead of the other side of the leading edge.

Accordingly, as the paper P enters the photosensitive drum 135, the paper is skewed, and thus a skew occurs in the image printed on the paper.

A conventional method to solve the above problem is to provide a clutch (not shown) for regulating the rotation of the feeding roller 147, or a paper leading edge aligning device (not shown), such as a shutter member (not shown), for selectively opening and closing the paper transferring path 141. However, as such constituting members are added, this conventional method has disadvantages of increased fabrication costs, a complicated structure, and an increased manufacturing time.

SUMMARY OF THE INVENTION

The present invention has been developed to solve the above problems in the related art. Accordingly, an aspect of the present invention is to provide an image forming apparatus having a paper transferring device that is improved in construction to prevent an image from being skew-printed by using a simple structure that requires an inexpensive manufacturing cost.

The above and/or other aspects are achieved by providing an image forming apparatus according to an embodiment of the present invention, including a plurality of guide members forming a paper transferring path that connects a paper feeding device with a photosensitive drum, a feeding roller that transfers a sheet of paper toward the photosensitive drum along the paper transferring path, and at least one transferring roller disposed on the paper transferring path between the feeding roller and the paper feeding device to transfer the paper sheet picked up from the paper feeding device towards the feeding roller. The plurality of guide members include a first guide member disposed near the feeding roller, and a notch that aligns the leading edge of the paper sheet, parallel in relation to a rotational axis of the feeding roller while the paper sheet is being transferred along the paper transferring path.

Accordingly, printing quality deterioration due to an entering of the paper sheet into the feeding roller in an oblique relationship is efficiently prevented.

According to a an embodiment of the present invention, the plurality of guide members includes a second guide member that connects the first guide member with the transferring roller, which is formed such that the lower surface of the paper is curved, while the paper sheet is transferred under the guidance of the second guide member. The notch may be formed on the lower surface of the first guide member.

Each of the first and the second guide members may be provided in plural numbers, or alternatively, the first and the second guide members may be integrally formed with each other for convenience in the manufacturing process of the image forming apparatuses. The plurality of guide members further include a third guide member that guides the paper sheet on the lower surface, while the paper sheet is transferred along the paper transferring path.

Additional aspects and advantages of the invention will be set forth in part in the description which follows and, in part, will be obvious from the description, or may be learned by practice of the invention.

Accordingly, the leading edge of the paper sheet is, upon contacting with the notch, curved such that the upper surface of the paper sheet comes into a contact with the lower surface of the second guide, and as a result, the leading edge of the paper sheet is separated from the notch and enters the feeding roller.

The notch is formed such that the inner circumference thereof for contacting with the leading edge of the paper sheet is inclined with respect to the lower surface of the first guide member at a predetermined angle, enabling easy separation of the paper sheet from the notch.

BRIEF DESCRIPTION OF THE DRAWINGS

These and/or other aspects and advantages of the present invention will become more apparent and more readily appreciated from the following description of the embodiments, taken in conjunction with the accompanying drawings of which.

Figure 1:
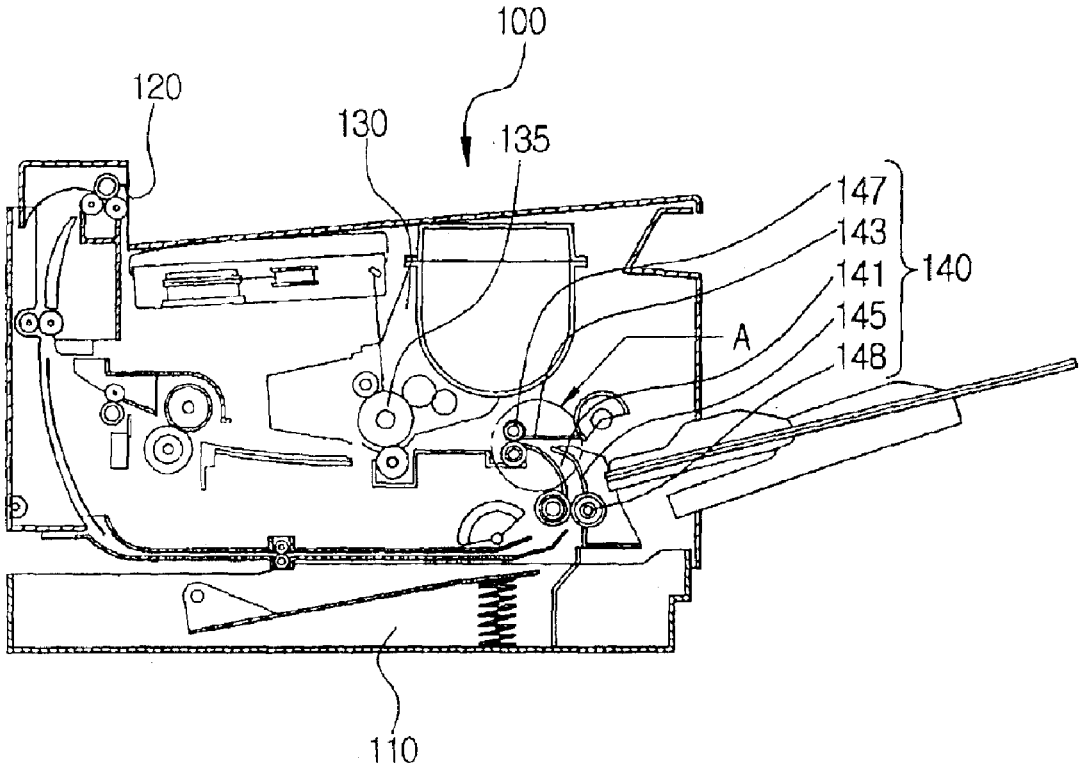
FIG. 1 (PRIOR ART)
FIG. 1 is a side section view schematically showing a conventional image forming apparatus having a paper transferring device.
Figure 2:
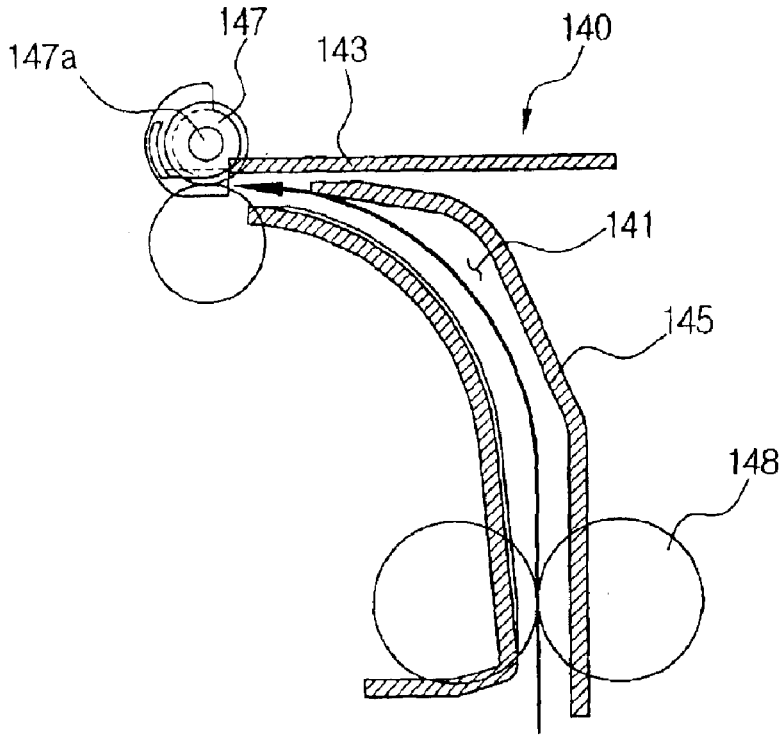
FIG.2 (PRIOR ART)
FIG. 2 is a side section view showing the A part of FIG. 1 in greater detail.
Figure 3:
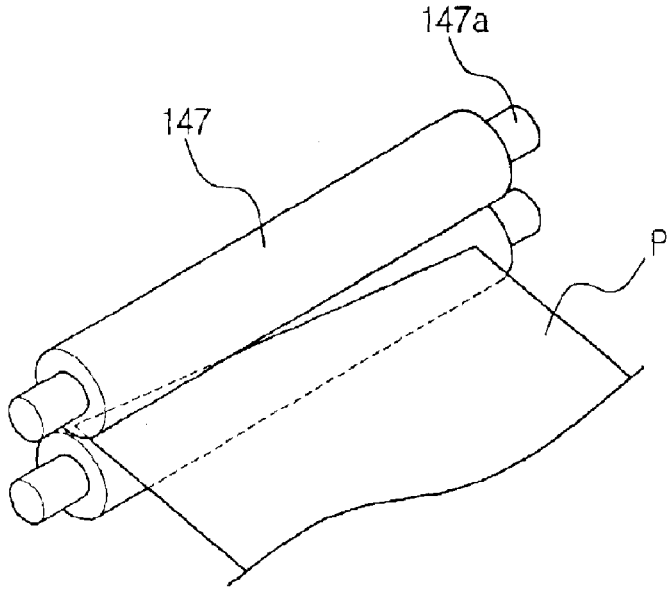
FIG.3 (PRIOR ART)
FIG. 3 is a perspective view showing the paper transferred by the conventional paper transferring device.

DESCRIPTION OF THE PREFERRED EMBODIMENT are described in greater detail with reference to the accompanying drawings. Meanwhile, with respect to elements identical to those of the conventional image forming apparatus as shown in FIGS. 1 to 3, like reference numerals will be assigned.] Reference will now be made in detail to the present embodiments of the present invention, examples of which are illustrated in the accompanying drawings, wherein like reference numerals refer to the like elements throughout. The embodiments are described below in order to explain the present invention by referring to the figures.

Figure 4:
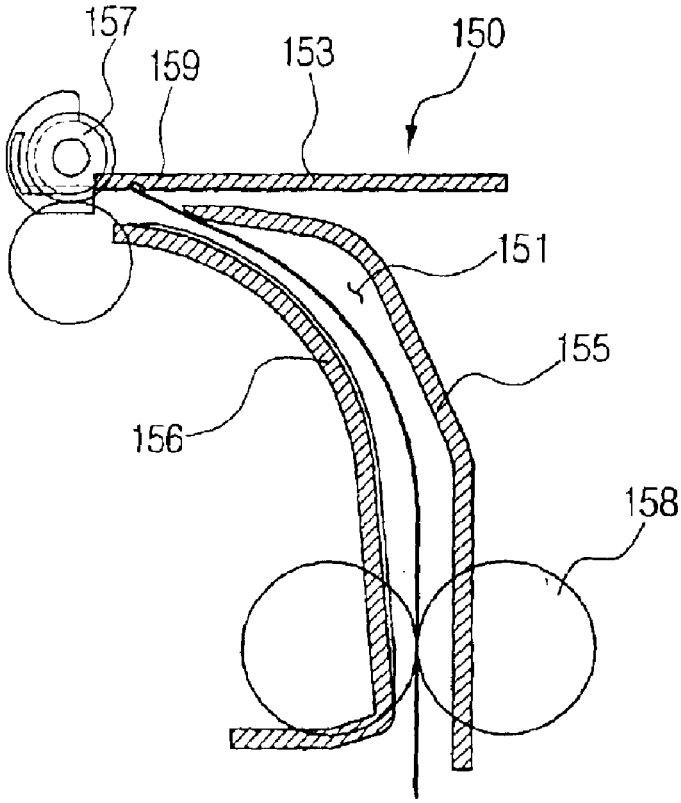
FIG. 4 is a side section view schematically showing a part of a paper transferring device according to a first embodiment of the present invention.

FIG. 4 shows a paper transferring device 150 for an image forming apparatus 100 (Refer to FIG. 1) according to a first embodiment of the present invention. As shown in FIG. 4;, the paper transferring device 150 includes a paper transferring path 151, a plurality of guide members, a feeding roller 157, transferring rollers 158, and a paper leading edge aligning means.

The paper transferring path 151 connects a paper feeding device 110 (Refer to FIG. 1) and a photosensitive drum 135 (refer to FIG. 1) and is defined in a predetermined shape by the plurality of guide members securely disposed in the image forming apparatus 100. The plurality of guide members includes first, second and third guide members 153, 155, 156, for guiding transferring of the paper by contacting one side of the paper where the image is printed hereinbelow, it is called an upper surface) and the other side of the paper (hereinbelow, it is called a lower surface) during the paper transferring operation. At this time, the second and the third guide members 155 and 156 are disposed on the paper transferring path 151 so that the first guide member 153 securely disposed on the paper transferring path 151 adjacent to the feeding roller 157 is connected to the transferring rollers 158. The second guide member 155 is formed in a curved shape so that the lower surface of the paper bends inward when the paper is guided from the transferring rollers 158 to the first guide member 153 by the second guide member 155. Meanwhile, the first guide member 153 is shaped in a manner so that a lower surface thereof contacting the upper side of the paper is parallel to the bottom surface of the image forming apparatus 100.

On the paper transferring path 151 a plurality of rollers serve as a paper transferring unit supplying a driving force necessary for the paper transferring operation. The feeding roller 157 and the plurality of transferring rollers 158 serve as the paper transferring unit in this embodiment The feeding roller 157 is disposed at the upstream portion of the photosensitive drum 135 in a paper transferring direction and supplies a driving force to transfer the paper to the photosensitive drum 135. The transferring rollers 158 supply a driving force to transfer the paper picked-up from the paper feeding device 110 to the feeding roller 157. The number of the transferring rollers 158 and the installation position thereof may vary according to the length and the shape of the paper transferring path 151.

Figure 5:
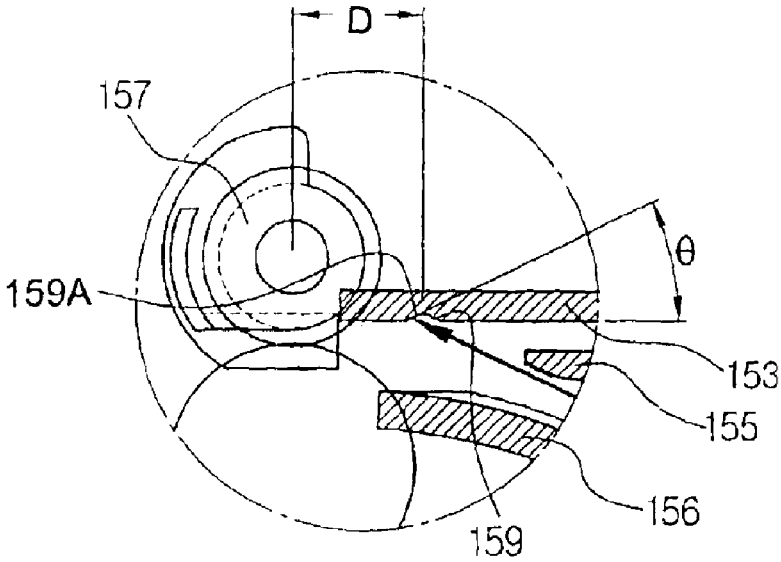
FIG. 5 is a side section view showing in greater detail the main part of the paper transferring device according to the first embodiment of the present invention.

Meanwhile, a paper leading edge aligning unit aligns a leading edge of the paper so that the leading edge of the paper is located parallel relation to the rotation shaft 147 A (refer to FIG. 3) of the feeding roller 157 as the paper enters the feeding roller 157. In order to perform this alignment, the paper leading edge aligning unit includes a notch 159 defined by cutting a part from the lower surface of the first guide member 153. As shown in FIG. 5, the notch 159 is defined in the lower surface of the first guide member 153 and spaced from the feeding roller 157 by a predetermined distance D. On the inner surface of the notch 159 is formed an inclined surface 159A that comes into contact with the leading edge of the paper guided by the second guide member 157. Preferably, the inclined surface 159A of the notch 159 forms a predetermined angle θ with the lower surface of the first guide member 153 parallel to the bottom surface of the image forming apparatus 100.

Hereinbelow, the descriptions are made about the operations of the paper transferring device of the image forming apparatus according to an embodiment of the present invention.

Figure 6:
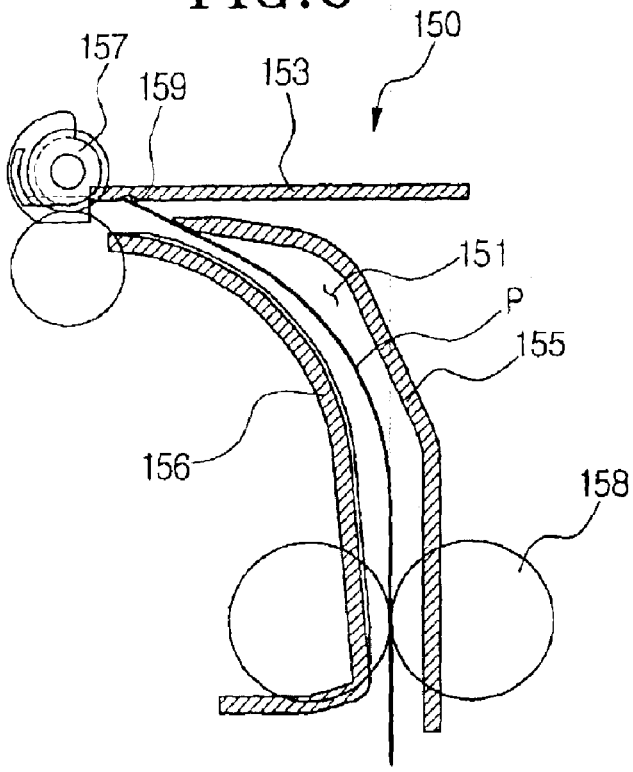
FIGS. 6 and 7 are side section views showing the sequential operations of the paper transferring device according to the first embodiment of the present invention.
Figure 7:
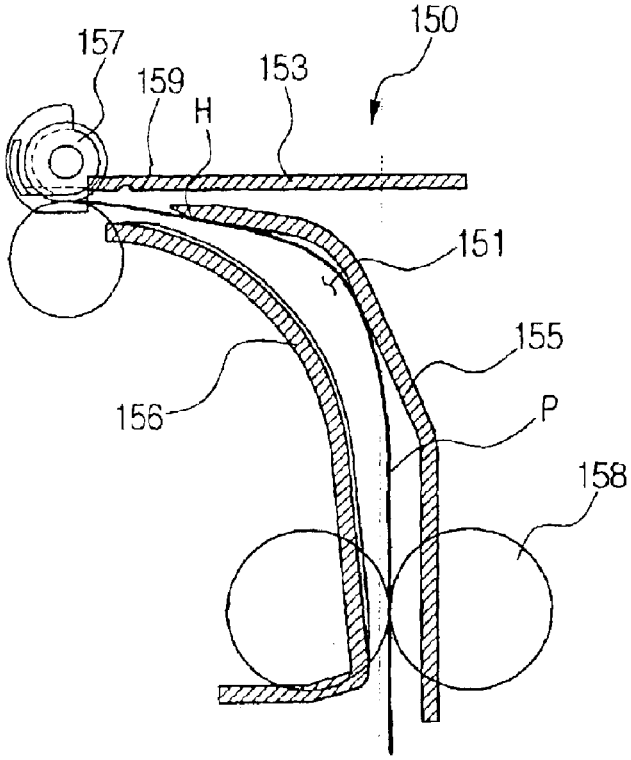

As shown in FIG. 6, the paper P picked-up from the paper feeding device 110 is transferred towards the feeding roller 157 by the rotation of the transferring rollers 158. At this point, the paper P becomes bent due to the curved shape of the second guide member 155. The paper P is transferred to the first guide member 153 under the guidance of the second guide member 155, and the leading edge of the paper P contacts the inclined surface 159A of the notch 159 defined in the first guide member 153 before the paper P enters the feeding roller 157. The leading edge of the paper P is subjected to an impulse having a predetermined magnitude in accordance with the paper transferring speed, and due to the impulse, and the leading edge of the paper P is aligned parallel to the rotation shaft 147A of the feeding roller 157. In this embodiment, the notch 159 is generally formed in the lower surface of the first guide member 153 with its lengthwise direction being parallel to an axial direction of the rotation shaft 147A of the feeding roller 157.

Meanwhile, the rotation of the transferring rollers 158 continues after the leading edge of the paper P comes into contact with the inclined surface 159A of the notch 159. Accordingly, the paper P becomes bent to the shape that the lower surface of the second guide member 155 allows. When the front side of the paper P comes into contact with the lower surface of the second guide member 155, the leading edge of the paper P is lowered due to the recovering force of the bent paper P and also by the leverage principle, in which a terminal end of the second guide member 155 serves as a fulcrum (H). Then, the leading edge of the paper P is separated from the notch 159. The leading edge of the paper P enters the feeding roller 157, and then proceeds to the photosensitive drum 135. After a predetermined image is formed on the upper surface of the paper P by the photosensitive drum 135, the paper is discharged through a discharging port 120 (Refer to FIG. 1).

In order for the leading edge of paper P bent in a predetermined shape to be separated from the notch 159, the inclined surface 159A of the notch 159 generally forms a predetermined inclining angle θ with respect to the lower surface of the first guide member 153. The inclining angle E may vary according to the shape of the paper transferring path 151. In the case that the notch 157 is spaced from the feeding roller 157 by approximately 8.5 mm, as in the embodiment example described herein, it the inclining angle is typically 8.5°.

Although each of the first to third guide members 153, 155, 156 is depicted as a single member, it should not be considered as limiting.

Figure 8:
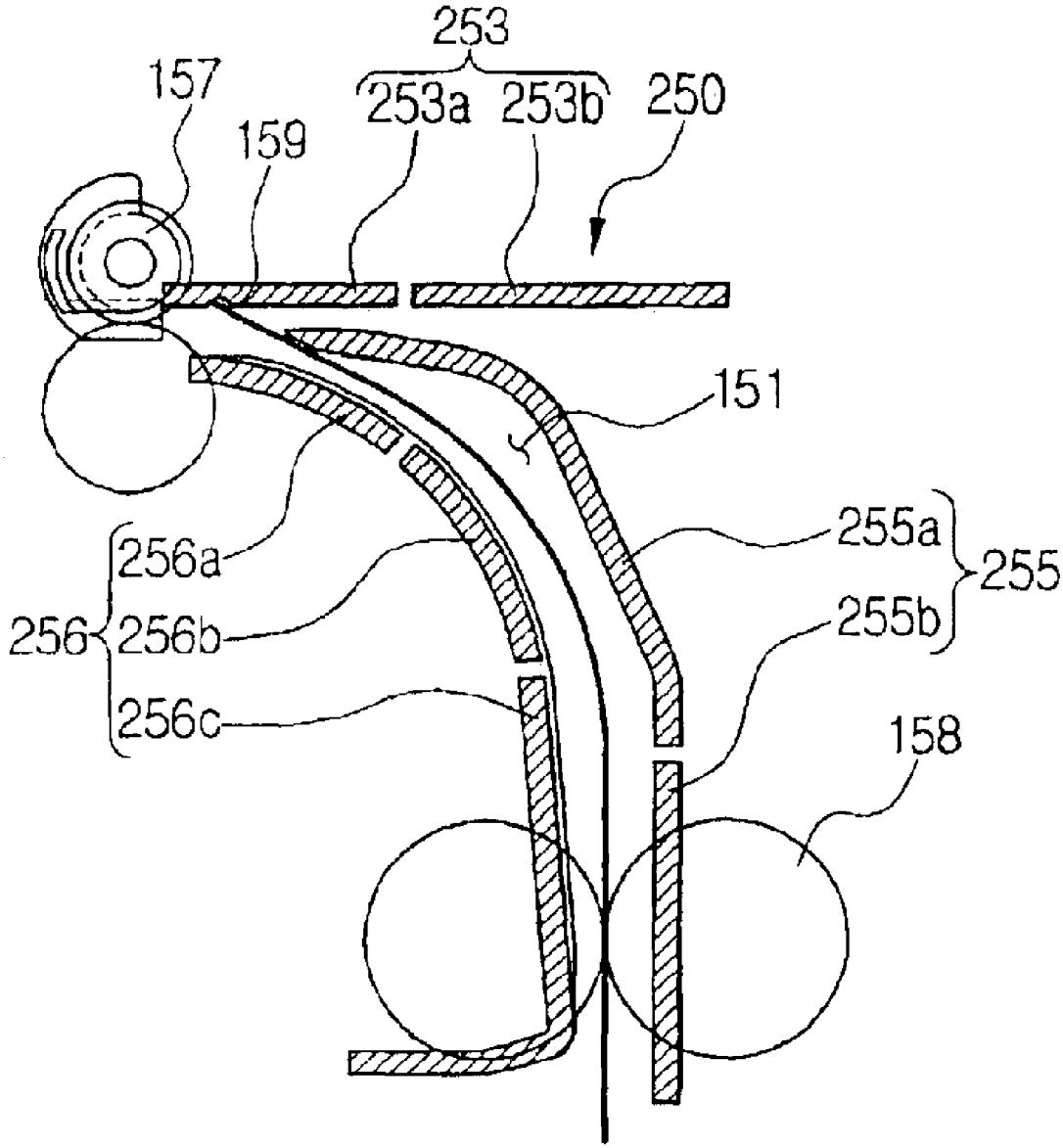
FIG. 8 is a side section view showing a part of a paper transferring device according to a second embodiment of the present invention.

According to the second embodiment of the present invention, which is representatively shown in FIG. 8, the paper transferring device 250 may have plural guide members 253*a*, 253*b* provided as the first guide member 253 along the paper transferring path 151, plural guide members 255*a*, 255*b* provided as the second guide member 255 along the paper transferring path 151, and plural guide members 256*a*, 256*b*, 256*c* provided as the third guide member 256 along the paper transferring path 151, and still provides an effect substantially the same as that of the first embodiment.

Albeit not shown, additional embodiments such as providing the first and the second guide members 153, 155 in an integrated form, or providing the paper transferring device 150, 250 in a combined structure of the first and the second embodiments, may also provide substantially the same function and effect as those of the first embodiment.

The paper transferring device 150, 250 according to the embodiments of the present invention, as constructed above, by providing a simple and inexpensive design, i.e., by providing the notch 159 in the conventional guide member 153 forming the paper transferring path 151, prevents the paper from being skewed.

The foregoing embodiments and advantages are merely exemplary and are not to be construed as limiting the present invention. The present teaching may be readily applied to other types of apparatuses. The description of the present invention is intended to be illustrative, and not to limit the scope of the claims. Many alternatives, modifications, and variations will be apparent to those skilled in the art. The claims are intended to cover the structures described herein that perform the recited function and include all types of equivalents. Thus, although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. An image forming apparatus, comprising:

a plurality of guide members forming a paper transferring path connecting a paper feeding device and a photosensitive drum;

a feeding roller disposed on a side of the paper transferring path adjacent to the photosensitive drum, the feeding roller transferring a paper incoming along the paper transferring path to the photosensitive drum; and at least one transferring roller disposed on the paper transferring path between the feeding roller and the paper feeding device, the transferring roller transferring the paper picked-up from the paper feeding device to the feeding roller; wherein the plurality of guide members comprise a first guide member disposed near to the feeding roller, and the first guide member includes a notch that aligns a leading edge of the paper being transferred along the paper transferring path so that the leading edge of the paper is aligned parallel to a rotation axis of the feeding roller.

2. The image forming apparatus of claim 1, wherein the notch is formed at a lower surface of the first guide member.

3. The image forming apparatus of claim 1, wherein the plurality of guide members comprise a second guide member connecting the first guide member with the transferring roller, and the paper is guided along the second guide member in a curve so that a lower surface of the paper bends inward when the paper is transferred along the second guide member.

4. The image forming apparatus of claim 3, wherein the leading edge of the paper, upon contacting with the notch, bends by a movement of the transferring roller such that the upper surface of the paper contacts the lower surface of the second guide member, and wherein the leading edge of the paper is separated from the notch and enters the feeding roller.

5. The image forming apparatus of claim 3, wherein the second guide member is provided in plural numbers.

6. The image forming apparatus of claim 3, wherein the plurality of guide members further comprise a third guide member that guides the lower surface of the paper being transferred along the paper transferring path.

7. The image forming apparatus of claim 3, wherein the first and the second guide members are integrally formed with each other.

8. The image forming apparatus of claim 1, wherein the notch is formed such that an inner circumference thereof for contacting the leading edge of the paper is inclined with respect to a lower surface of the first guide member at a predetermined angle.

9. The image forming apparatus of claim 1, wherein the first guide member is provided in plural numbers.

10. A paper guidance system for an image forming apparatus, comprising:

a first guide member having a lower surface thereof contacting an upper side of a paper, and a notch that is disposed on the lower surface, for aligning a leading edge of the paper so that the leading edge of the paper is aligned in parallel with a feeding roller;

a second guide member contacting the upper side of the paper and formed in a curved shape; and a third guide member contacting a lower side of the paper that is guided by the second guide member.

11. The paper guidance system of claim 10, wherein the notch is formed at a lower surface of the first guide member.

12. The paper guidance system of claim 10, wherein a lower surface of the second guide member is curved so that the paper bends toward the feeding roller when the paper is transferred along the second guide member.

13. The paper guidance system of claim 12, wherein the leading edge of the paper, upon contacting with the notch, bends such that the upper surface of the paper contacts the lower surface of the second guide member, and wherein the leading edge of the paper is separated from the notch and enters the feeding roller.

14. The paper guidance system of claim 10, wherein the first and the second guide members are integrally formed with each other.

15. The paper guidance system of claim 10, wherein the notch is formed such that an inner circumference thereof for contacting the leading edge of the paper is inclined with respect to the lower surface of the first guide member at a predetermined angle.

16. A paper guidance system for an image forming apparatus, comprising:

a feeding roller for the image forming apparatus, to feed a paper to an image forming system; and a plurality of guide members forming a paper transferring path, wherein the plurality of guide members comprises a first guide member disposed near to the feeding roller, the first guide member including a notch that aligns a leading edge of the paper so that the leading edge of the paper is aligned parallel with a rotation axis of the feeding roller.

17. The paper guidance system of claim 16, wherein the plurality of guide members comprises:

a second guide member contacting the upper side of the paper and formed in a curved shape; and a third guide member contacting a lower side of the paper that is guided by the second guide member.

18. The paper guidance system of claim 17, wherein the leading edge of the paper, upon contacting with the notch, bends such that the upper surface of the paper contacts the lower surface of the second guide member, and wherein the leading edge of the paper is separated from the notch and enters the feeding roller.

19. The paper guidance system of claim 17, wherein the first and the second guide members are integrally formed with each other.

20. The paper guidance system of claim 16, wherein the first guide member has a lower surface thereof contacting the upper side of the paper, and the notch is formed at a lower surface of the first guide member.

21. The paper guidance system of claim 16, wherein a lower surface of the second guide member is curved so that the paper bends toward the feeding roller when the paper is transferred along the second guide member.

22. The paper guidance system of claim 16, wherein the notch is formed such that an inner circumference thereof for contacting the leading edge of the paper is inclined with respect to the lower surface of the first guide member at a predetermined angle.

23. An image forming apparatus, comprising:

a plurality of guide members forming a paper transferring path connecting a paper feeding device and a photosensitive drum;

a feeding roller disposed on a side of the paper transferring path adjacent to the photosensitive drum, the feeding roller transferring a paper incoming along the paper transferring path to the photosensitive drum; and at least one transferring roller disposed on the paper transferring path between the feeding roller and the paper feeding device, the transferring roller transferring the paper picked-up from the paper feeding device to the feeding roller;

wherein the plurality of guide members comprises a combined structure of a first guide member and a second guide member, the first guide member disposed near to the feeding roller and including a notch that aligns a leading edge of the paper being transferred along the paper transferring path so that the leading edge of the paper is aligned parallel to a rotation axis of the feeding roller, and the second guide member integrally connected to the first guide member with the transferring roller to guide the paper in a curve so that a lower surface of the paper bends inward when the paper is transferred along the second guide member.

24. An image forming apparatus, comprising:

a plurality of guide members forming a paper transferring path connecting a paper feeding device and a photosensitive drum;

a feeding roller disposed on a side of the paper transferring path adjacent to the photosensitive drum, the feeding roller transferring a paper incoming along the paper transferring path to the photosensitive drum; and at least one transferring roller disposed on the paper transferring path between the feeding roller and the paper feeding device, the transferring roller transferring the paper picked-up from the paper feeding device to the feeding roller;

wherein the plurality of guide members comprise a notch that aligns a leading edge of the paper being transferred along the paper transferring path to prevent the paper from being skewed.

* * * * *

UNITED STATES PATENT AND TRADEMARK OFFICE

CERTIFICATE OF CORRECTION

PATENT NO. : 6,934,505 B2
DATED : August 23, 2005
INVENTOR(S) : Sang-yob Shin

It is certified that error appears in the above-identified patent and that said Letters Patent is hereby corrected as shown below:

Column 6,
Line 45, replace "first" with -- third --.

Signed and Sealed this

Ninth Day of May, 2006

JON W. DUDAS
*Director of the United States Patent and Trademark Office*